US006571527B1

(12) United States Patent
Rattini

(10) Patent No.: US 6,571,527 B1
(45) Date of Patent: Jun. 3, 2003

(54) ELONGATE STRUCTURAL MEMBER COMPRISING A ZIGZAG WEB AND TWO CHORDS WHEREIN ONE CHORD COMPRISES A CHANNEL WITH INWARDLY DIRECTED LIPS ON THE CHANNEL ENDS

(75) Inventor: Thomas L. Rattini, Maryville, IL (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 09/665,381

(22) Filed: Sep. 20, 2000

(51) Int. Cl.[7] ..... E04C 3/02
(52) U.S. Cl. ..... 52/692; 52/729.2
(58) Field of Search ..... 52/729.1, 729.2, 52/729.5, 690, 692, 691, 693, 694

(56) References Cited

U.S. PATENT DOCUMENTS

| | | | | |
|---|---|---|---|---|
| 1,651,032 A | | 11/1927 | Macomber | |
| 1,675,825 A | | 7/1928 | Schlafly | |
| 1,880,480 A | | 10/1932 | Ragsdale | |
| 2,169,253 A | * | 8/1939 | Kotrbaty | 52/693 |
| 2,246,215 A | | 6/1941 | Nagin et al. | |
| 2,624,430 A | | 1/1953 | Macomber | |
| 2,860,743 A | | 11/1958 | Cliff | |
| 3,221,467 A | | 12/1965 | Henkels | |
| 3,288,977 A | | 11/1966 | Keller | |
| 3,845,594 A | | 11/1974 | Butts et al. | |
| 4,037,098 A | | 7/1977 | Kowalski | |
| 4,102,108 A | * | 7/1978 | Cody | 52/693 |
| 4,146,074 A | | 3/1979 | Kowalski | |
| 4,253,210 A | | 3/1981 | Racicot | |
| 4,283,157 A | | 8/1981 | Kowalski | |
| 4,305,557 A | | 12/1981 | Kowalski | |
| 4,305,677 A | | 12/1981 | Kowalski | |
| 4,460,299 A | | 7/1984 | Kowalski | |
| 4,506,487 A | | 3/1985 | Hill | |
| 4,546,591 A | | 10/1985 | Beltz | |
| 4,937,997 A | | 7/1990 | Thomas, Jr. et al. | |
| 5,003,748 A | | 4/1991 | Carr | |
| 5,022,614 A | | 6/1991 | Rinderer | |
| 5,100,086 A | | 3/1992 | Rinderer | |
| 5,163,644 A | | 11/1992 | Kowalski | |
| 5,209,619 A | | 5/1993 | Rinderer | |
| 5,848,770 A | | 12/1998 | Oliver et al. | |

OTHER PUBLICATIONS

Unistrut Corporation, *Moduspan: Space Frame Systems*, 1975 and 1976, pp. 1–7, 10–11 and 16–19, (Brochure SF–77).

Unistrut Corporation, *"Unistrut" Product Specifications*, 1955, 2 pages.

Unistrut Corporation, *"Unistrut" Mezzanines*, 1967, 2 pages.

* cited by examiner

*Primary Examiner*—Carl D. Friedman
*Assistant Examiner*—Naoko Slack
(74) *Attorney, Agent, or Firm*—Senniger, Powers, Leavitt & Roedel

(57) ABSTRACT

An elongate structural member comprises a first chord and a second chord extending lengthwise with a web spanning a space therebetween. The web comprises at least one length of metal bar stock having zigzag bends. A first set of bends is disposed along a first margin of the web and a second set of bends is disposed along a second margin of the web. The first chord comprises at least two struts, with one on each side of the web at a respective web margin. Each strut comprises a metal channel having generally opposing walls having inwardly directed lips at their outer ends. The lips are spaced from one another to define a slot extending the length of the strut. Each strut is secured in engagement with the respective side of the web and is adapted for insertion through its slot of items to be retained in the strut.

39 Claims, 15 Drawing Sheets

FIG. 54
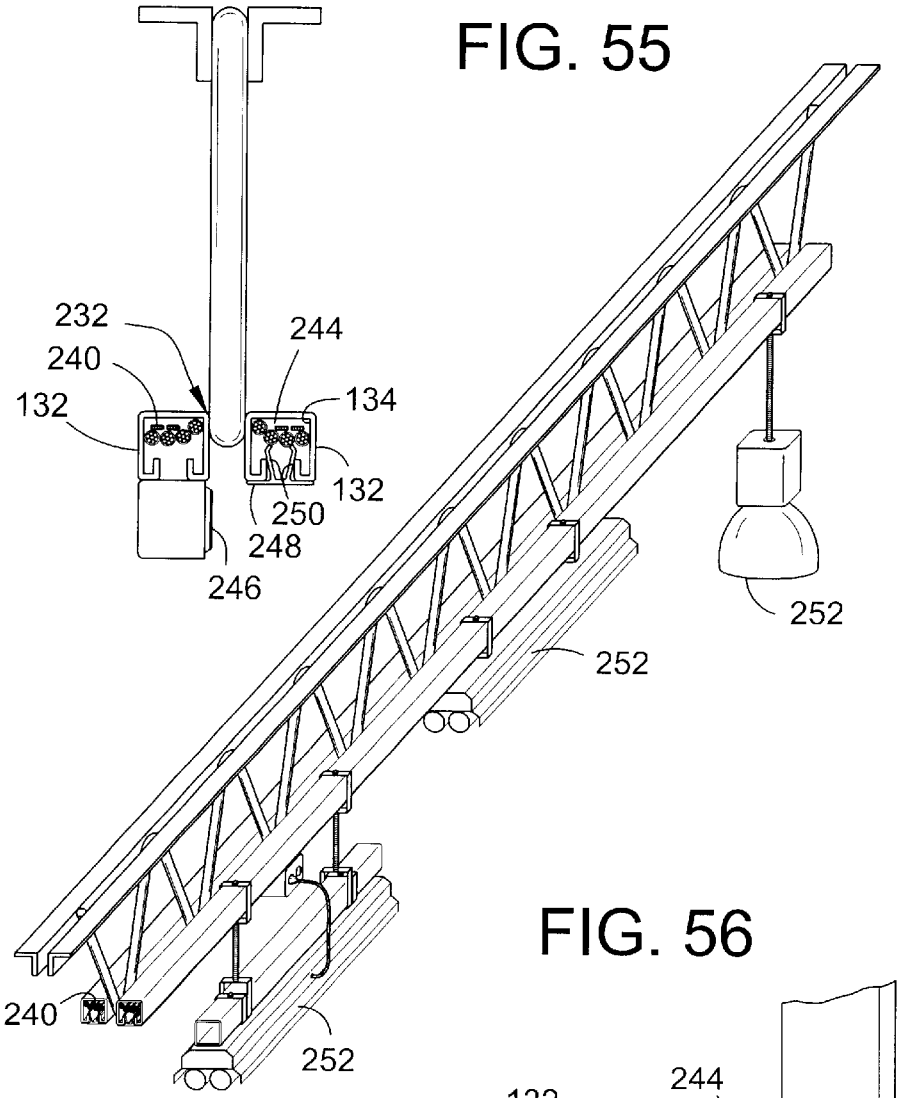
FIG. 55
FIG. 56
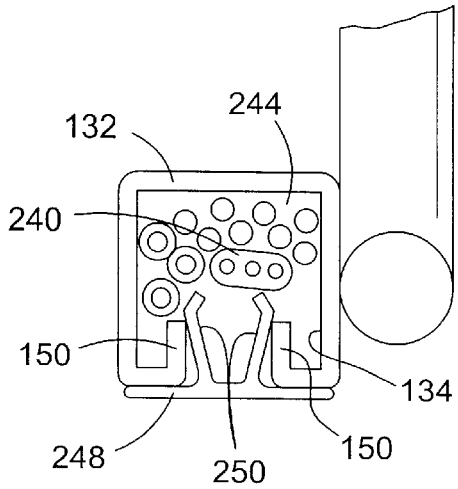

ELONGATE STRUCTURAL MEMBER COMPRISING A ZIGZAG WEB AND TWO CHORDS WHEREIN ONE CHORD COMPRISES A CHANNEL WITH INWARDLY DIRECTED LIPS ON THE CHANNEL ENDS

BACKGROUND OF THE INVENTION

This invention generally relates to load bearing members and more particularly to an improved elongate structural member in the form of a truss, fabricated, at least in part, from strut, the term "strut" being used in the industry as referring to a channel-shaped member of the type shown, for example, in co-assigned U.S. Pat. No. 5,022,614.

Conventionally, prefabricated structural trusses provide a primary mechanism for spanning and supporting distances within building structures. These trusses may be manufactured and assembled as generic parts, off-site. On-site installation is simplified because the installation crew can install a pre-assembled truss, rather than building the truss by hand on-site. The primary function of a structural truss is to provide support for floors, ceilings, and related objects in modern buildings. Trusses are conventionally constructed from pairs of angle bars acting as chords and bar rod formed in a zigzag configuration spanning a distance between the chords and acting as a web (see FIG. 1). The chords and web are typically joined by welding.

Structural trusses are often installed in horizontal series, creating an array of trusses. Truss arrays are then installed as sub-floors in multistory buildings. Decking and finish flooring are conveniently placed on top of a truss array, forming a floor. The bottom of the truss array may then be used to attach various intermediate attachment items, such as strut, for supporting objects beneath. These objects, supported from the items, include electrical wires, electrical fixtures, telephone and computer related cables, plumbing hardware, climate control equipment, ventilation ducts, etc. Direct attachment of these objects to the truss array is not possible, because trusses do not offer attachment features. Suspending the aforementioned objects from conventional truss arrays is typically accomplished by attaching strut members to a truss array. Strut members are elongate channel-shaped members which are typically roll-formed from elongate metal sheets of uniform thickness. The channel of the strut allows for attachment of items to the strut, and objects may then attach to those items. For illustration of the prior art means for attachment, reference can be made to co-assigned U.S. Pat. No. 4,037,098 (swivel connector), U.S. Pat. No. 4,146,074 (fastener), U.S. Pat. No. 4,238,157 (connector), U.S. Pat. No. 4,305,557 (pipe hanger), U.S. Pat. No. 4,460,299 (fastener), U.S. Pat. No. 5,022,614 (one-piece conduit clip), U.S. Pat. No. 5,100,086 (cable tray support system), U.S. Pat. No. 5,163,644 (conduit clamp), U.S. Pat. No. 5,209,619 (channel nut fastener), and U.S. Pat. No. 5,848,770 (clevis hanger)

SUMMARY OF THE INVENTION

Among the several objects and features of the present invention may be noted the provision of an elongate structural member which permits ready attachment of objects directly to the member; the provision of an elongate structural member which efficiently incorporates the load bearing qualities of a truss and the attachment benefits of strut; the provision of an elongate structural member which permits attachment of objects from below, beside, and above the member; the provision of an elongate structural member which incorporates channel shaped struts as part or all of one or more chords of the member; the provision of an elongate structural member which permits the chords to function as electrical wiring raceways; the provision of an elongate structural member which permits ready attachment of cross bracing between two or more structural members for increased lateral rigidity; the provision of selecting and varying the type of trusses installed for a particular application, increasing the flexibility of the design and allowing building designers to choose load bearing members while considering what objects need be attached below and above the truss; the provision of efficiently incorporating the benefits of strut into a commercially successful truss design; and the provision of an elongate structural member fabricated at least in part from strut and adapted for applications where the chords of the member are not parallel.

Generally, an elongate structural member comprises a first chord, a second chord and a web. The first chord and second chord extend lengthwise of the structural member with a space therebetween. The web spans the space and is comprised of at least one length of metal bar stock of solid cross section. The web further has bends along the length of zigzag configuration. A first set of bends is disposed along a first margin of the web and a second set of bends is disposed along a second margin of the web. The first chord comprises at least two struts, one on each side of the web at a respective margin of the web. Each strut is comprised of a metal channel having generally opposing side walls constituting flanges. The flanges have inwardly directed lips at their outer ends which are spaced from one another to define a slot therebetween. The slot extends the length of the strut. Each strut is secured in engagement with the respective side of the web and is adapted for insertion through its slot of items to be retained in the strut.

In a second embodiment of the present invention, an elongate structural member comprises a first chord, a second chord and a web generally as set forth above. The web structure is comprised of at least a plurality of metal bars extending diagonally with respect to the chords. One set of bars on one side of the chords have end portions in engagement with the outside of the strut and another set of bars on the other side of the chords have end portions in engagement with the outside of the strut. The end portions of the bars are secured to the strut.

In a third embodiment of the present invention, an elongate structural member comprises a first chord, a second chord and a web generally as set forth above. The first chord is comprised of at least two struts with flanges and inwardly directed lips. Each of the lips has a hook-like configuration for gripping engagement by the items to be retained in the strut.

In a fourth embodiment of the present invention, an elongate structural member comprises a first chord, a second chord and a web generally as set forth above. The first chord is comprised of at least two struts with flanges and inwardly directed lips. The lips extend inwardly from the respective flanges toward one another a distance of at least ⅛ inch.

In a fifth embodiment of the present invention, an elongate structural member comprises a first chord, a second chord and a web generally as set forth above. The web is constructed of structural members other than metal channel.

Other objects and features will be in part apparent and in part pointed out hereinafter.

BRIEF DESCRIPTION OF THE DRAWINGS

FIGS. 50–56 show several elongate structural members having objects attached thereto in different configurations.

Corresponding reference characters indicate corresponding parts throughout the several views of the drawings.

DETAILED DESCRIPTION OF THE PREFERRED EMBODIMENTS

Figure 1:
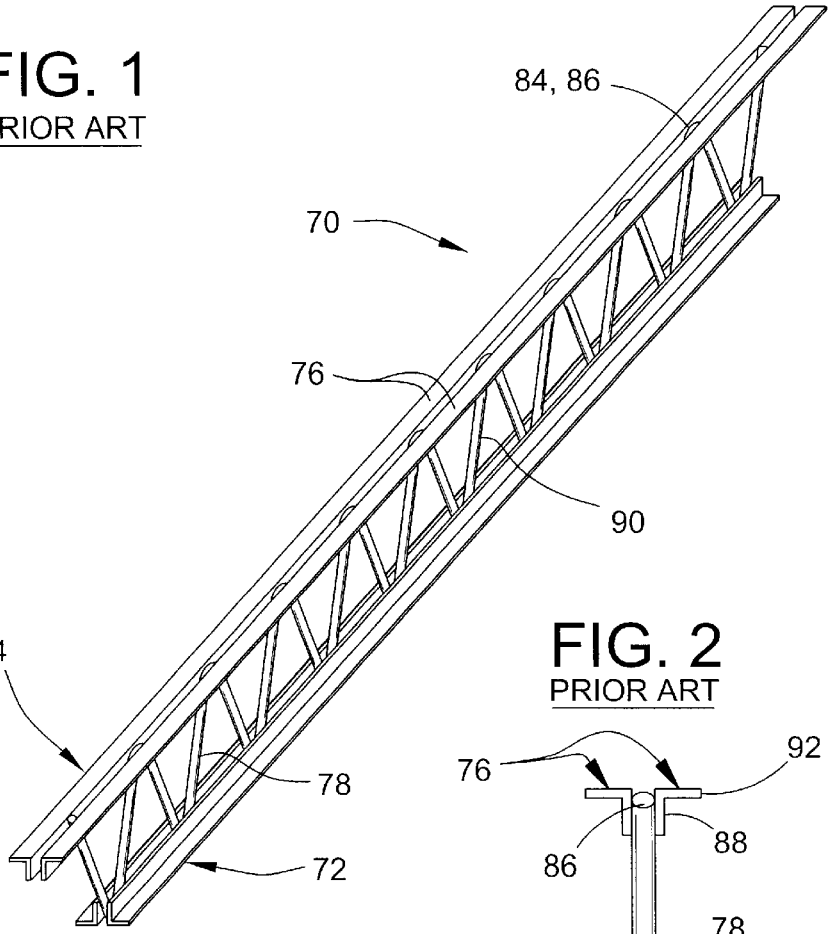
FIG. 1 PRIOR ART
FIG. 1 is a perspective view of a prior art structural truss.

Referring now to the drawings and specifically to FIG. 1, a conventional building truss of the type widely used in the construction industry is generally indicated at 70. The truss has a first chord generally indicated at 72 and a second chord generally indicated at 74, each comprised of a pair of elongate angle bars 76 spaced apart a distance equal to the width of a web 78. For convenience of description, the first chord 72 and the second chord 74 shall be referred to as bottom chord 72 and top chord 74, respectively. These designations of top and bottom are not meant to be limiting with respect to the orientation of the structural member, but rather to facilitate the reader in quickly understanding the figures and description. The web 78 is conventionally formed by bending a piece of round bar stock 90 of solid cross section in a zigzag configuration. The first set of bends 80 is disposed along a first longitudinal margin 82 of the web 78 and a second set of bends 84 is disposed along a second longitudinal margin 86. The first longitudinal margin 82 and the second longitudinal margin 86 shall be referred to as a bottom margin 82 and top margin 86, respectively, for convenience of description.

Figure 2:
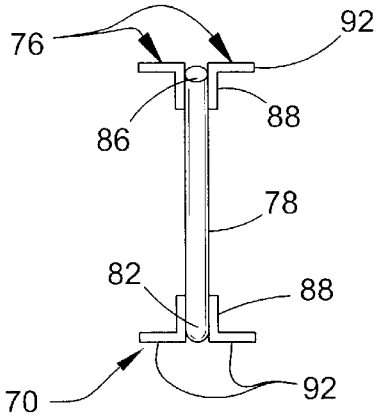
FIG. 2 PRIOR ART
FIG. 2 is an end view of the truss shown in FIG. 1.

Referring to FIG. 2, the angle bars 76 are typically connected to the web 78 by welding the vertical legs 88 of the lower pair of angle bars to the bottom margin 82 of the web and by welding the vertical legs of the upper pair of angle bars to the top margin 86 of the web. The angle bars 76 are oriented so that the non-welded legs 92 point laterally outward away from the web 78. Preferably, the legs 92 of the angle bars 76 at the bottom margin 82 of the web 78 are generally coplanar with one another and the edge of the bottom margin, and the legs of the angle bars at the top margin 86 are generally coplanar with one another and the edge of the top margin. This conventional truss 70 has a single purpose, to carry the load of the structure in which it is installed. The truss 70 is not equipped with attachment features for mounting or hanging objects. Rather, additional clamps, brackets, and/or strut are required to facilitate attachment of objects to the truss 70.

Figure 4:
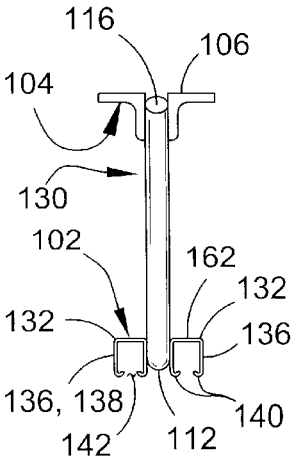
FIG. 4 is an end view of the elongate structural member of FIG. 3.
Figure 5:
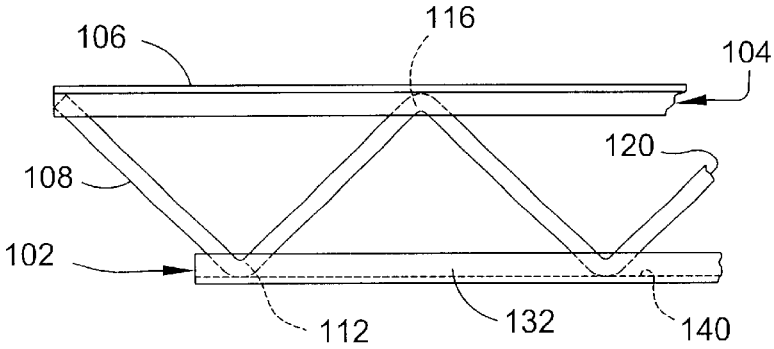
FIG. 5 is a side view of the elongate structural member of FIG. 3.
Figure 3:
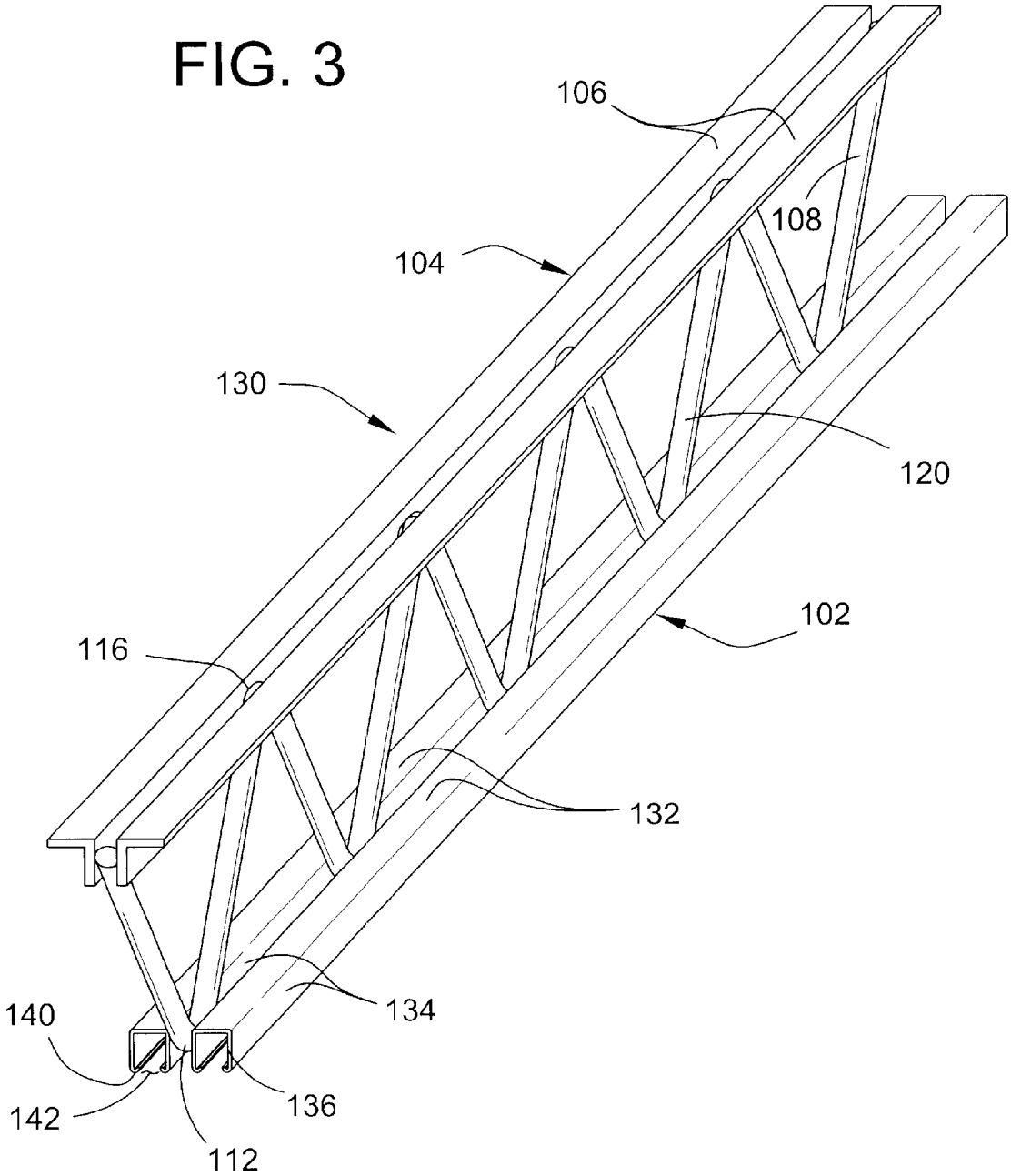
FIG. 3 is a perspective view of an elongate structural member of the present invention.

Referring to FIG. 3, an elongate structural member of the present invention permitting ready attachment of objects directly to the member is generally indicated at 130. The structural member comprises a bottom chord generally indicated at 102 and a top chord generally indicated at 104 extending lengthwise of the structural member. The top chord 104 is formed from conventional angle bars 106 as shown in FIGS. 1 and 2 and described above. The bottom chord 102 is comprised of two struts 132 (FIG. 4). The struts 132 and angle bars 106 are spaced apart a distance equal to the width of a web 108 of the elongate member. The struts 132 and angle bars 106 are connected to the web 108 along the web margins 112/116 (FIG. 5). In the preferred embodiment, the struts 132 and angle bars 106 are welded to the web margins 112/116, but it is contemplated that each angle bar 106 and each strut 132 may be fixedly attached to the web 108 by different means, depending on the application. The web 108 is conventionally formed from at least one piece of round bar stock 120 of solid cross section bent in a zigzag configuration.

Figure 8:
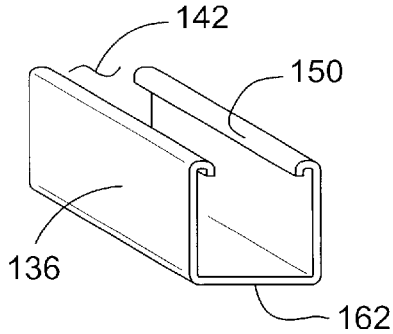
FIG. 8 is a perspective view of the strut of FIG. 7.

The struts 132 comprising the bottom chord 102 of the structural member perform both load-bearing and attachment functions. The struts 132 act as tension members of the elongate structural member. Further, the struts 132 are constructed to perform another function, the attachment of objects directly to the structural member, vis-a-vis the struts. The struts 132 arranged as the bottom chord 102 are elongate channels 134 having opposing side walls 136 constituting flanges of the channel, and a web or back wall 162 connecting the flanges (FIG. 8). The side walls 136 have inwardly directed lips 140 at their outer ends. The lips 140 are spaced apart from one another, forming a slot 142 which runs the length of the strut 132. The slot 142 is formed to receive items to be retained in the strut 132.

Figure 6:
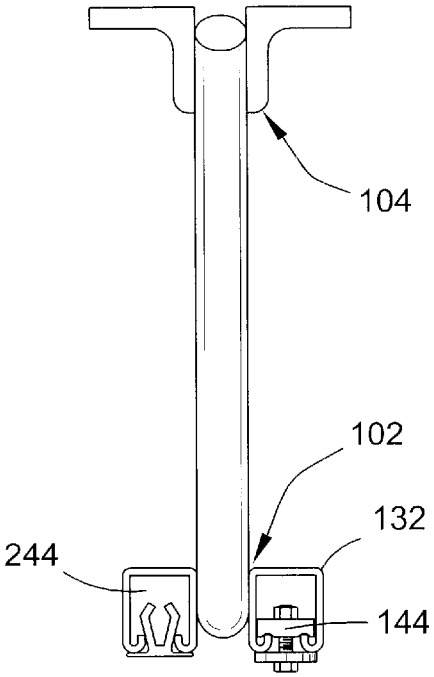
FIG. 6 is an enlarged end view of the elongate structural member comprising a pair of struts, one used as a raceway for electrical wiring and the like and the other for attachment of an object thereto by means of a fastening device in the form of a nut.

In the first embodiment (FIG. 3), the slots 142 of the two struts 132 face down. In this orientation, various fastening items (nuts, clips, hangers, etc.) can be inserted up through the slot 142 for engagement with the lips 140 of the strut 132 to suspend objects from the strut. Several such fastening devices are described in the U.S. Patents referenced above. Accordingly, the present invention allows for attachment of items directly to the structural member, without the need for additional strut or the like. As shown in FIG. 6, an elongate structural member having two struts 132 arranged as the bottom chord 102 is capable of supporting multiple objects. One strut 132 is used as a raceway 244 for electrical wiring and the like. The other strut 132 has a fastening device in the form of a grip nut 144 inserted in its slot 142 for attaching an object to the strut. One such nut suitable for this purpose is sold under the Trademark TWIRL-NUT® by B-Line Systems, Inc. of Highland, Ill., U.S.A. This nut is inserted inwardly with and through the slot 142 and then turned clockwise relative to the strut 132 so that the ends of the nut 144 engage the legs of the strut. A bolt or rod threaded through the nut is sold to attach an object to the strut 132.

Struts 132 with various cross-sectional shapes are contemplated. The following description of different cross sectional shapes is not intended to be limiting but rather to more fully describe a sampling of different strut 132 shapes. In each of the strut embodiments hereinafter referenced, the preferred construction calls for the lips 140 to extend inwardly a distance D or at least ⅛ of an inch from the side walls 136 of the strut. Further, the preferred construction calls for the slot 142 to have a width W which is preferably ⅞ of an inch to accommodate standard items within the strut. The width of the strut may vary from the nominal ⅞ of an inch without departing from the scope of the invention.

Figure 7:
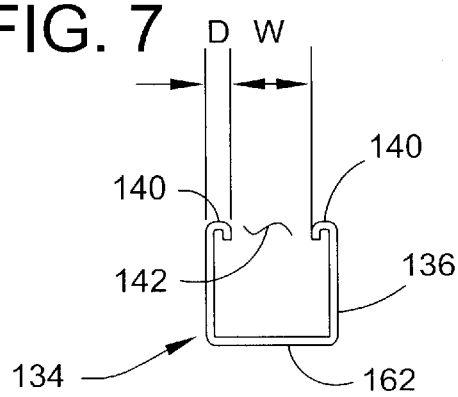
FIG. 7 is an end view of a strut of square cross sectional shape with a hook-like lips.

In FIGS. 7 and 8, a strut 132 of square cross sectional shape with hook-like lips 150 forming a slot 142 is shown. The hook-like lips 150 strengthen the strut 132 in the vertical direction, allowing for attachment of heavier loads to the strut. Moreover, the hook-like lips 150 are designed for engagement by a variety of fastening devices. For example, U.S. Pat. No. 4,146,074 shows a TWIRL-NUT® fastener comprising a nut with parallel grooves having upstanding teeth for engaging the hook-like lips 150 of the strut 132. The teeth hold the fastener against slipping lengthwise along the strut 132. Similarly, U.S. Pat. No. 5,209,619 shows a channel nut fastener having teeth on the nut for engaging the hook-like lips of the strut to prevent slipping. U.S. Pat. No. 4,410,298 shows a fastener having a similar groove and teeth design for preventing slippage. U.S. Pat. No. 5,022,614 shows a one-piece conduit clip having two rectangular toes for engaging the hook-like lips 150 of the strut 132. U.S. Pat. No. 4,305,677 shows a connector for joining two pieces of strut 132 end-to-end. The connector has sidewalls and edges for engaging the hook-like lips.

Additionally, the strut 132 shown in FIGS. 7 and 8 is of uniform thickness (e.g., 12 gage steel) throughout the back wall 162, side wall 136, and hook-like lips 150. The uniform thickness of the strut 132 allows it to be cold roll formed from a single piece of mild carbon steel sheet for ease and efficiency of manufacture. For different applications, the thickness of the sheet metal is commonly 12 gage, 14 gage, or 16 gage, with 12 gage being the most common. These thicknesses are applicable to each of the disclosed strut shapes. Strut thickness affects both the total load bearing capability of the truss and the maximum load attachable to the individual strut members.

Figure 9:
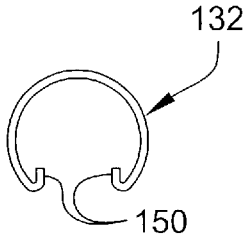
FIGS. 9–18 are end views of strut members having various cross sectional shapes.
Figure 10:
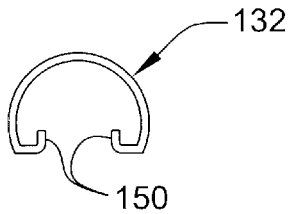
Figure 11:
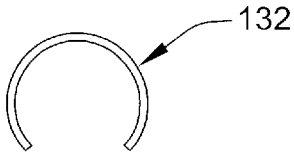
Figure 12:
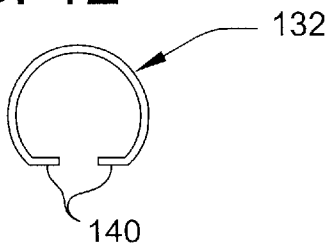
Figure 13:
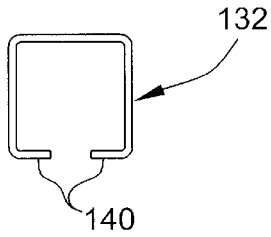
Figure 14:
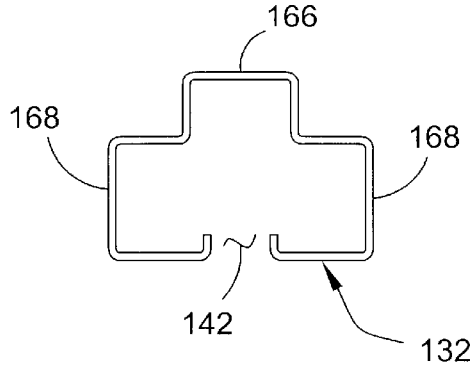
Figure 15:
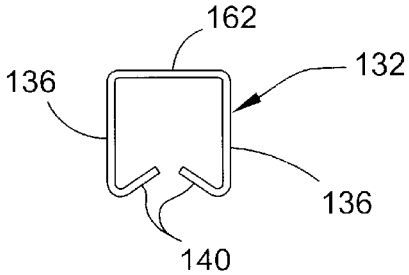
Figure 16:
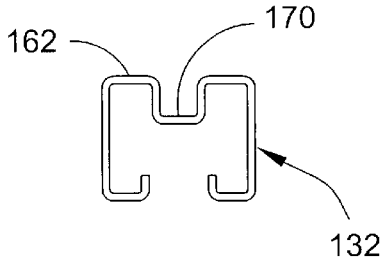

FIGS. 9–18 depict struts 132 having other cross sectional shapes useful in the production of elongate structural members of the present invention. FIG. 9 shows a strut 132 of round cross sectional shape with hook-like lips 150. FIG. 10 shows a strut 132 with a C-shaped cross section with hook-like lips 150. FIG. 11 shows a strut 132 of round cross sectional shape with no inwardly directed lips. FIG. 12 shows a strut 132 with a C-shaped cross section with inwardly directed generally co-planar lips 140. FIG. 13 shows a strut 132 with a square cross sectional shape and inwardly directed generally co-planar lips 140. FIG. 14 shows a strut 132 with a three-lobe cross sectional shape. The strut has a central lobe 166 opposite the slot 142 and two side lobes 168. FIG. 15 shows a strut 132 with a square cross sectional shape having flat, inwardly directed lips 140 angled toward the back wall 162 of the strut 132. FIG. 16 shows a strut 132 of generally rectangular cross sectional shape with an indentation 170 in the back wall 162 for receiving the web 108 of the structural element. It is anticipated that any of the aforementioned strut 132 shapes may be used singly or in combination with other struts in each of the patented embodiments.

Figure 17:
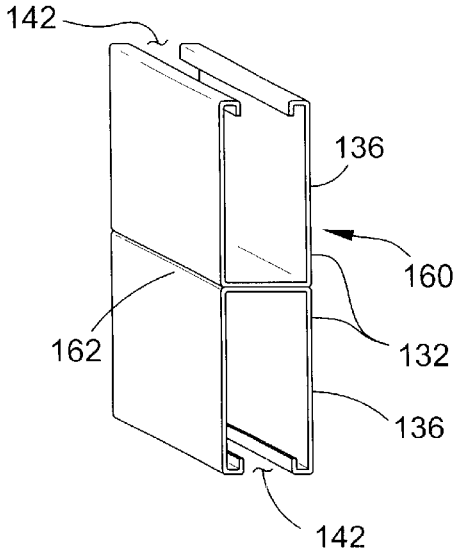
Figure 18:
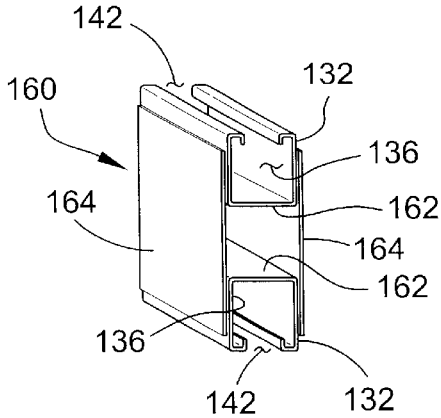

As shown in FIG. 17 and in later embodiments, two or more struts 132 may be joined together, forming a composite strut, generally indicated at 160, having more than one slot 142. More specifically, FIG. 17 shows a pair of struts 132 of rectangular cross sectional shape joined at their respective back walls 162 so that their respective slots 142 open away from one another in opposite directions. Composite struts 160 may also be formed from strut 132 and other elongate members, such as elongate metal sheets 164 (FIG. 18). As shown in FIG. 18, a composite strut 160 may be formed from two square struts 132 having spaced-apart back walls 162 and oppositely facing slots 142, and two elongate sheets 164 fixedly attached (e.g., welded) to the side walls 136 of the struts. Such a composite strut 160 could be formed from any of the variously shaped struts 132 disclosed herein as well as other combinations not specifically described.

FIGS. 19–38 depict various embodiments of strut 132, angle bar 106, round bar stock 120, and other structural bars arranged to create elongate structural members (e.g., trusses) which are part of the family encompassed by the present invention. Unless otherwise indicated, the structural bars making up the chords, generally indicated at 102/104, are preferably attached to the web 108 by welding. Other attachment means known in the art, such as mechanical fasteners and adhesives, are within the scope of this invention. In addition, unless otherwise specified, the web 108 is preferably constructed from round bar stock 120 bent into zigzag configuration. Other web 108 designs, such as those based on square tubular bar 180 or angle bar 106, are also within the scope of this invention.

Figure 19:
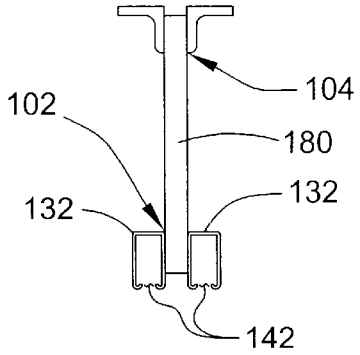
FIGS. 19–38 are end views of elongate structural members of various constructions.
Figure 20:
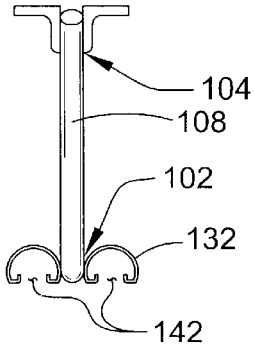
Figure 21:
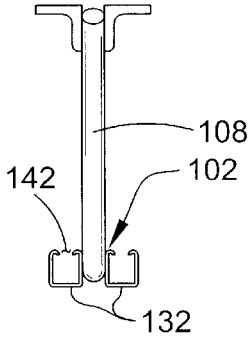
Figure 22:
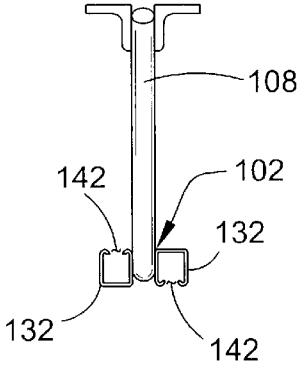

FIG. 19 shows an elongate structural member with two rectangular struts 132 arranged as a bottom chord, generally indicated at 102, with slots 142 facing down. This design additionally incorporates multiple separate segments of square tubular bar 180 extending diagonally with respect to the chords 102/104, acting as the web 108. FIG. 20 shows an elongate structural member with two round struts 132 arranged as a bottom chord, generally indicated at 102, with slots 142 facing down. FIG. 21 shows an elongate structural member with two square struts 132 arranged as a bottom chord 102, with slots 142 facing up. Struts 132 facing up provide different attachment methods for a variety of objects like pipes and flooring. FIG. 22 shows an elongate structural member with two square struts 132 arranged as a bottom chord, generally indicated at 102, with one slot 142 facing up and one slot facing down. This design adds flexibility to the attachment options available for the structural member because both upward and downward facing attachment options are available in one structural member.

Figure 23:
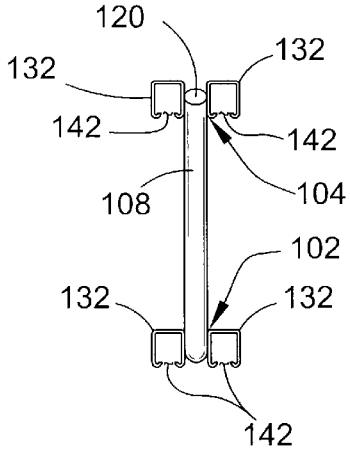
Figure 24:
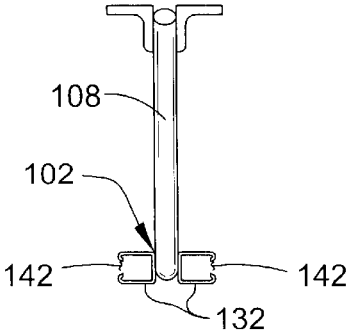
Figure 25:
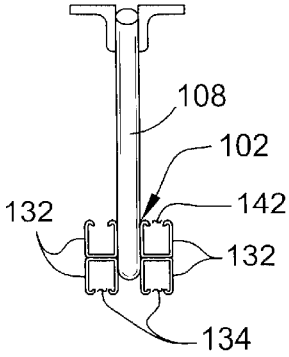
Figure 26:
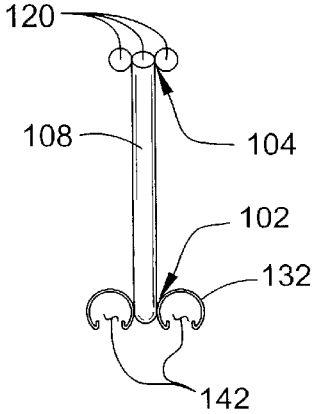

FIG. 23 shows an elongate structural member with two square struts 132 arranged as a bottom chord 102 and two square struts arranged as a top chord 104, the slots 142 of the struts facing down. A piece of round bar stock 120 in zigzag configuration acts as a web 108. Each of the strut members 132 may receive items (e.g., grip nuts, hangers, etc.) in their slots 142, which may then act as means for attaching objects to the strut. FIG. 24 shows an elongate structural member with two square struts 132 arranged as a bottom chord 102, the slots 142 of the struts facing laterally outward away from the web 108. FIG. 25 shows an elongate structural member with four square struts 132 arranged as a bottom chord 102 with two slots 142 facing up and two slots facing down. Pairs of oppositely oriented struts 132 are arranged back-to-back and attached to each side of the web 108. FIG. 26 shows an elongate structural member with two pieces of round bar stock 120 arranged as a top chord 104 and two round struts 132 arranged as a bottom chord 102, the slots 142 of the struts facing down. The chords 102/104 attach to a piece of round bar stock 120 in zigzag configuration acting as a web 108.

Figure 27:
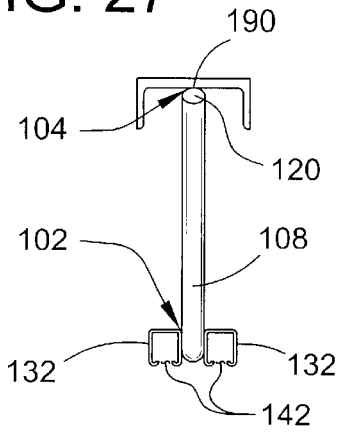

FIG. 27 shows an elongate structural member with channel beam arranged as a top chord 104 and two square struts 132 arranged as a bottom chord 102, the slots 142 of the struts facing down. A piece of round bar stock 120 in zigzag configuration acts as a web 108. The channel beam opens down and the top edge 190 of the web 108 attaches to the center of the channel beam by welding.

Figure 28:
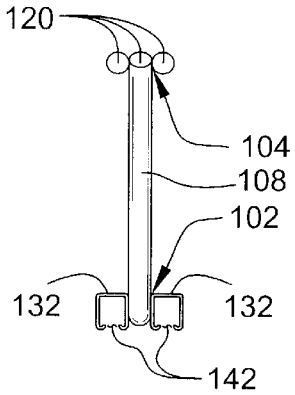
Figure 29:
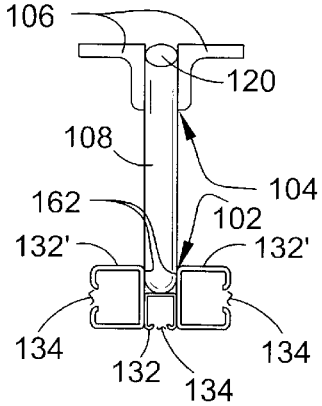

FIG. 28 shows an elongate structural member with two pieces of round bar stock 120 arranged as a top chord 104 and two square struts 132 arranged as a bottom chord 102, the slots 142 of the struts facing down. A piece of round bar stock 120 in zigzag configuration acts as a web 108. FIG. 29 shows an elongate structural member with two angle bars 106 arranged as a top chord 104. The bottom chord 102 is comprised of three separate pieces of strut 132. One square strut 132, with its slot 142 facing down, is centrally disposed, flanked by two rectangular struts 132' with their slots 142 facing laterally outward. Each strut 132/132' is welded to the round bar stock 120 acting as a web 108. The struts 132/132' are welded to the web 108 along their back walls 162. In addition, the back walls 162 of the rectangular struts 132' are welded to the side walls 136 of the square strut 132.

Figure 30:
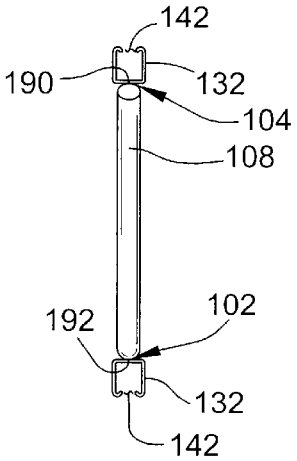
Figure 31:
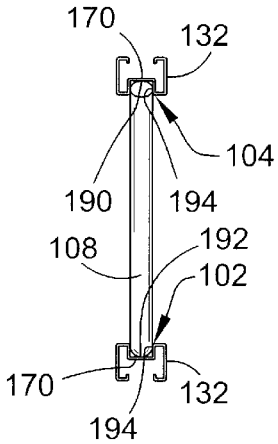
Figure 32:
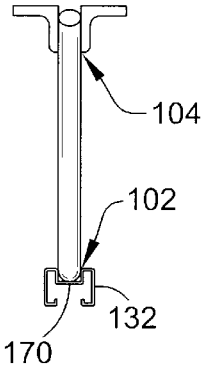
Figure 33:
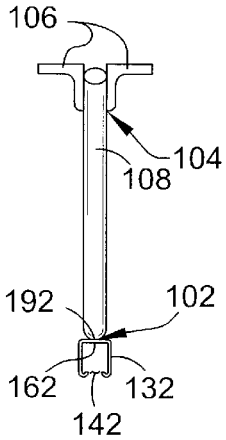

FIG. 30 shows an elongate structural member with one square strut 132 arranged as a bottom chord 102 with its slot 142 facing down and one square strut arranged as a top chord 104 with its slot facing up. A piece of round bar stock 120 in zigzag configuration acts as a web 108. The chord members 102/104 are attached to the top edge 190 and bottom edge 192 of the web margins 112/116, rather than to the sides of the web at its margins. FIG. 31 shows an elongate structural member comprising a web 108 and a bottom chord 102 fabricated using one strut 132 of generally rectangular cross sectional shape with an indentation 170 for receiving the lower margin of a web 108, the strut 132 having its slot 142 facing down. An identically shaped strut 132 is arranged as a top chord 104 with its slot 142 facing up. In this embodiment, the chords 102/104 are attached to the top edge 190, bottom edge 192, and sides 194 of the margins 112/116 of the web 108. FIG. 32 shows an elongate structural member having a bottom chord 102 similar to the previous embodiment (FIG. 31), and a top chord 104 similar to the embodiment of FIG. 3. FIG. 33 shows an elongate structural member with two angle bars 106 arranged as a top chord 104 and a single square strut 132 arranged as a bottom chord 102 with its slot 142 facing down. The single square strut 132 is attached to the bottom edge 192 of the web 108 at its back wall 162.

Figure 34:
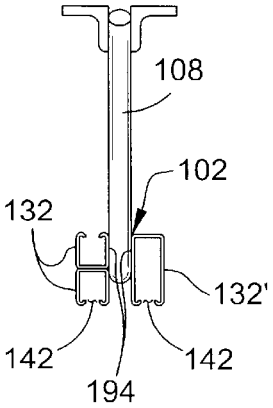
Figure 35:
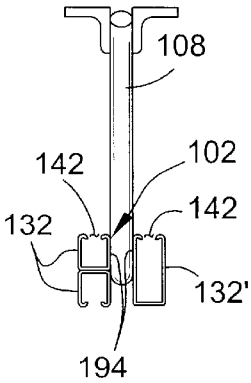
Figure 36:
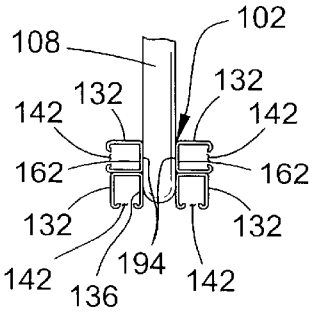

FIG. 34 shows an elongate structural member with two square struts 132 and one rectangular strut 132' arranged as a bottom chord 102. The two square struts 132 are disposed back-to-back on one side 194 of the web 108, with the slot 142 of one square strut facing up and the slot of the other square strut facing down. The rectangular shaped strut 132' is attached to the other side 194 of the web 108 with its slot 142 facing down. FIG. 35 is identical to the embodiment of FIG. 34, except that the slot 142 of the rectangular shaped strut 132' faces up. FIG. 36 is an enlarged end view of an elongate structural member with four square struts 132 arranged as a bottom chord 102. A pair of struts 132 are attached to each side 194 of the web 108. The two upper struts 132 are arranged with their slots 142 facing laterally outward away from the web 108, having their back walls 162 attached to the side 194 of the web. The two lower struts 132 are arranged with their slots 142 facing down, having their side walls 136 attached to the side 194 of the web 108.

Figure 37:
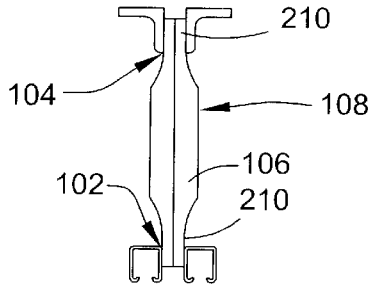
Figure 38:
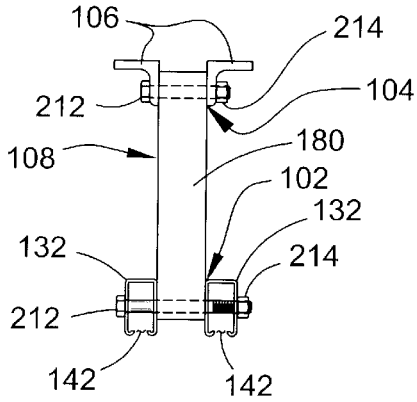

FIG. 37 shows an elongate structural member having a plurality of angle bars 106 acting as a web 108. The angle bars 106 making up the web 108 have flattened ends 210 designed in flatwise engagement with one another, thus allowing the bottom chord 102 and top chord 104 members to be readily attached to the flattened ends 210 of the web. FIG. 38 shows an elongate structural member with two angle bars 106 arranged as a top chord 104. Two rectangular struts 132 with their slots 142 facing down are arranged as a bottom chord 102. Multiple separate pieces of square tubular bar 180 extend diagonally with respect to the chords 102/104, forming the web 108. The chords 102/104 and web 108 are held together by bolts 212 through the margins 112/116 of the web 108. Holes in the angle bar 106, strut 132, and square tubular bar 180 allow for insertion of a bolt 212 on one side of the web 108 and installation of a nut 214 on the other side. It is understood that other fasteners could also be used without departing from the scope of the invention. Other fasteners include, but are not limited to, rivets, machine screws, and carriage bolts.

Figure 39:
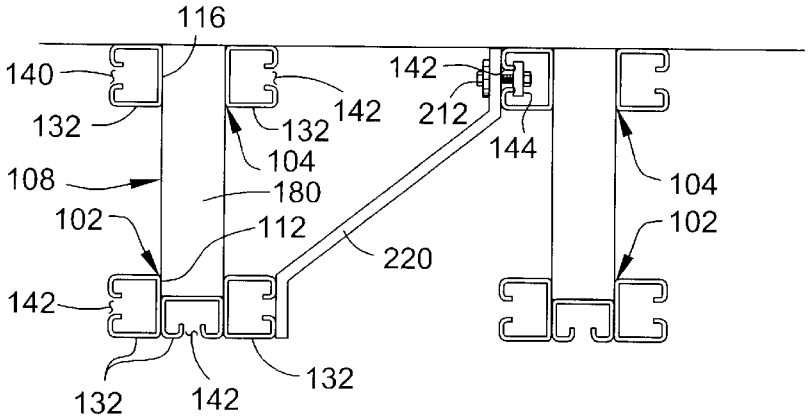
FIGS. 39–41 are end views of elongate structural members connected by cross braces of various constructions.

FIG. 39 shows a pair of elongate structural members each of which has a top chord 104 fabricated using two square struts 132 with their slots 142 facing laterally outward. The bottom chord 102 of each member is comprised of three separate struts 132, one centrally disposed square strut with its slot 142 facing down and two square struts arranged on opposite sides of the center square strut. The two square struts 132 arranged on the sides have their slots 142 facing laterally outward and are attached to the web along a bottom margin 112 thereof. Multiple pieces of square tubular bar 180 arranged in a zigzag configuration act as the web 108 of each structural member. The tubular bars of the web 108 extend diagonally with respect to the bottom chord 102 and top chord 104. The elongate structural members shown in FIG. 39 may be used without interconnection between adjacent members, or, as shown, with cross brace members 220 between the two members. These cross brace members 220 add horizontal rigidity to adjacent pairs of structural members. Each cross brace member 220 is formed from flat bar stock bent into the shape shown in FIG. 39 to engage top and bottom chords 102/104 of two adjacent elongate structural members. The cross brace member 220 may be attached to each chord member 102/104 by welding or by extending a bolt 212 through a hole in the cross brace into threaded support with a grip nut 144 in strut 132. Any other means of attaching the cross brace member 220 directly to the strut 132 is also contemplated as being within the scope of this invention.

Figure 40:
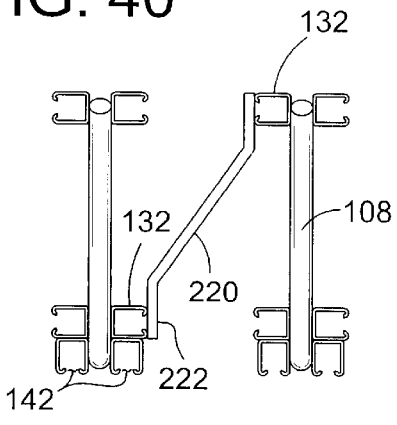
Figure 41:
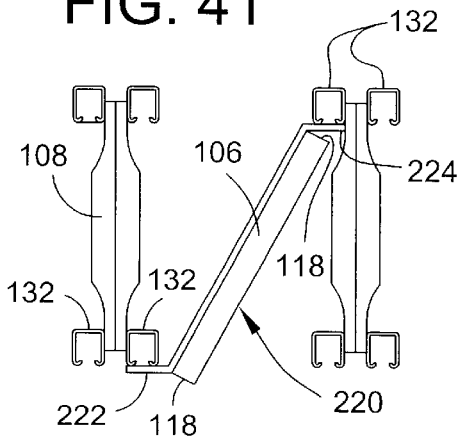

Cross bracing 220 may be incorporated into any of the existing elongate structural member embodiments. FIGS. 40 and 41 are illustrative of the flexibility of the cross bracing 220 configurations. FIG. 40 shows two elongate structural members joined by a cross brace member 220 formed from flat bar stock. This cross brace member 220 has vertical end portions attached to the two members. The cross brace 220 may be connected to two laterally outward facing struts 132 of the structural members as described above. Alternatively, the lower end portion 222 of the cross brace member 220 may be bent horizontal for engagement with the underside of a strut 132 of the bottom chord 102 where the slot 142 faces down. FIG. 41 demonstrates yet another embodiment, where the cross brace member generally indicated at 220 is formed from angle bar 106 and both the upper end portion 224 and the lower end portion 222 of the cross brace member are in horizontal engagement with the struts 132 of the elongate member. As illustrated, the cross brace 220 is fabricated from modified angle bar 106, where the upper end portion 224 and the lower end portion 222 of each cross brace have one leg 118 of the angle bar removed so that the angle bar may be easily shaped for proper orientation with and attachment to the strut 132.

Figure 42:
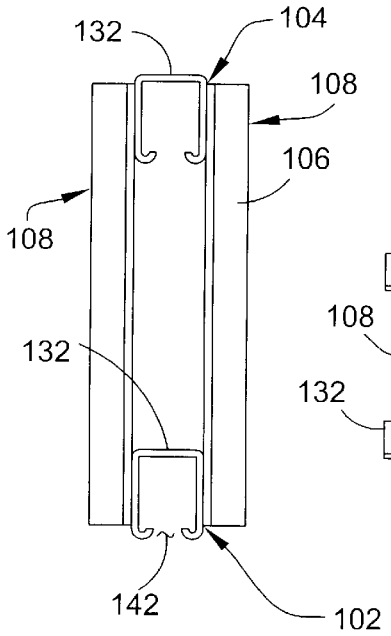
FIGS. 42–49 show various elongate structural members comprising webs fabricated from web members positioned on opposite sides of the chords.
Figure 43:
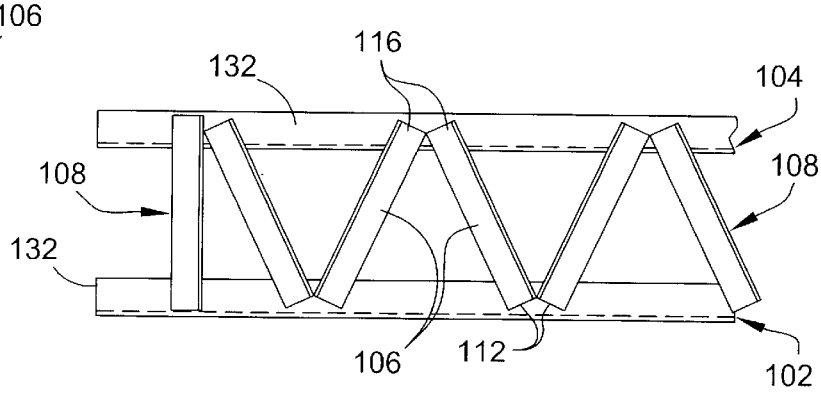
Figure 46:
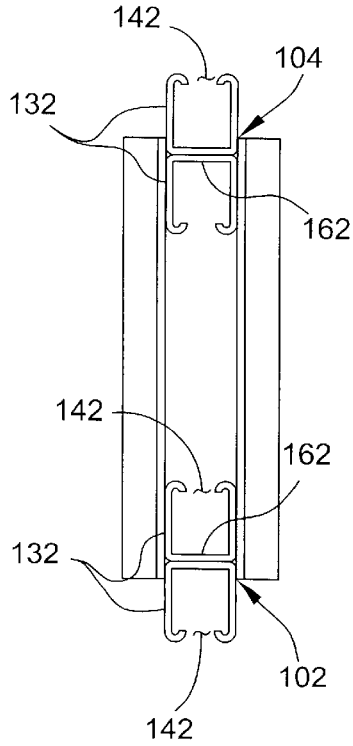
Figure 45:
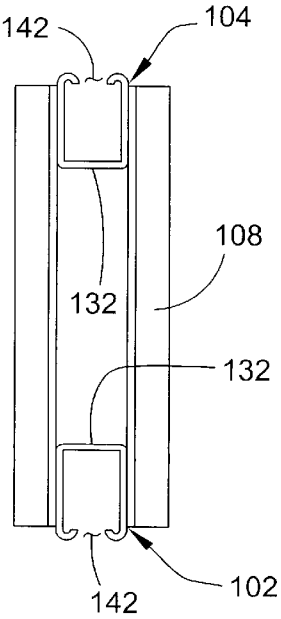
Figure 44:
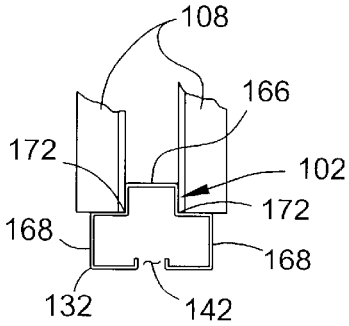

In another embodiment of the present invention, the bottom chord 102 and top chord 104 are centrally disposed (i.e., the bottom and top chords are disposed in the central vertical plane. or the truss) while the web. members 108 are arranged on both sides of the chords. FIGS. 42 and 43 show such a design. The bottom chord 102 and top chord 104 are formed from rectangular struts 132 with downward facing slots 142. The web 108 is formed from pieces of angle bar 106 in flatwise engagement and fixedly attached at their end margins 112/116 to the centrally disposed chord members 102/104. The web members 108 extend diagonally with respect to the chords 102/104. The preferred method of attaching the web members 108 to the chords 102/104 is by welding, although other means for attachment, such as mechanical fasteners and adhesives, are also contemplated. FIG. 44 discloses an alteration on the previous embodiment where the strut 132 of the bottom chord 102 has a three-lobe cross sectional shape. The strut 132 has a central lobe 166 opposite the slot 142 and two side lobes 168. The web members 108 are arranged to attach to the strut 132 along the side walls of the central lobe 166, above the two side lobes 168. The recesses 172 between the central lobe 166 and the side lobes 168 help position the web members 108 with respect to the strut 132. FIG. 45 is identical to the embodiment of FIGS. 42 and 43, except that the top chord 104 has its slot 142 facing up. FIG. 46 shows an embodiment whereby each chord 102/104 is formed from two square struts 132 attached back-to-back on their back walls 162 such that one slot 142 faces up and one slot faces down. All four struts of the embodiment are designed for ready attachment of items within their slots.

Figure 47:
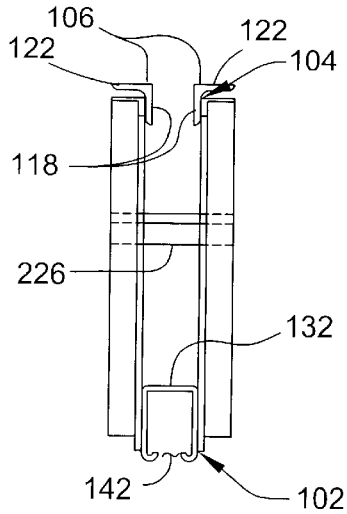
Figure 48:
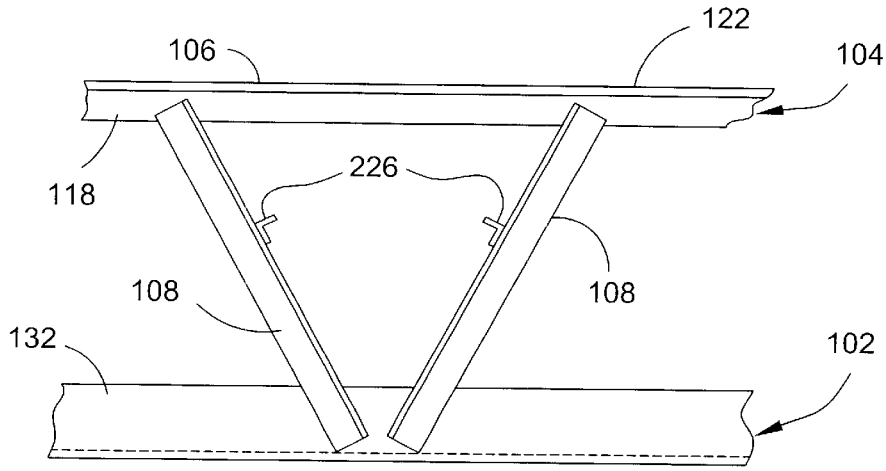

In another embodiment of the present invention shown in FIGS. 47 and 48, an elongate structural member has a bottom chord 102 comprising a rectangular strut 132 with its slot 142 facing down, and a top chord 104 comprising two angle bars 106 separated by a distance. The angle bars 106 acting as a top chord have vertical legs 118 welded to multiple angle bars arranged on opposite sides of the chords 102/104, acting as a web 108. Each angle bar 106 acting as a top chord 104 has a non-welded tangential leg 122 which faces laterally outward from the structural member. Finally, multiple pieces of angle bar 106 are welded horizontally between adjacent web members 108 as web reinforcements 226. These reinforcements 226 strengthen the upper portion of the truss since the top chord 104 members are not joined to one another.

Figure 49:
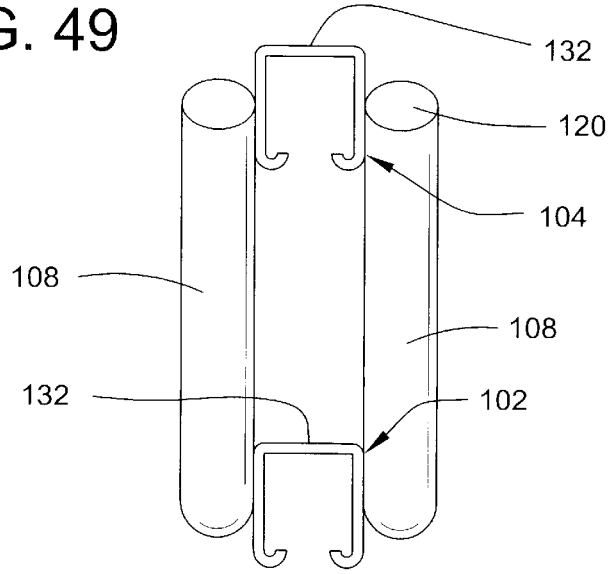

In yet another embodiment of the present invention shown in FIG. 49, an elongate structural member has a bottom chord 102 and a top chord 104 each comprising a strut 132 with its slot 142 facing down. The two chords 102/104 are centrally disposed while the web members 108 are arranged on either side of the chords. The web 108 is formed from two pieces of round bar stock 120 bent into zigzag configuration, with one piece of round bar stock attached to each side of the chords 102/104.

Figure 50:
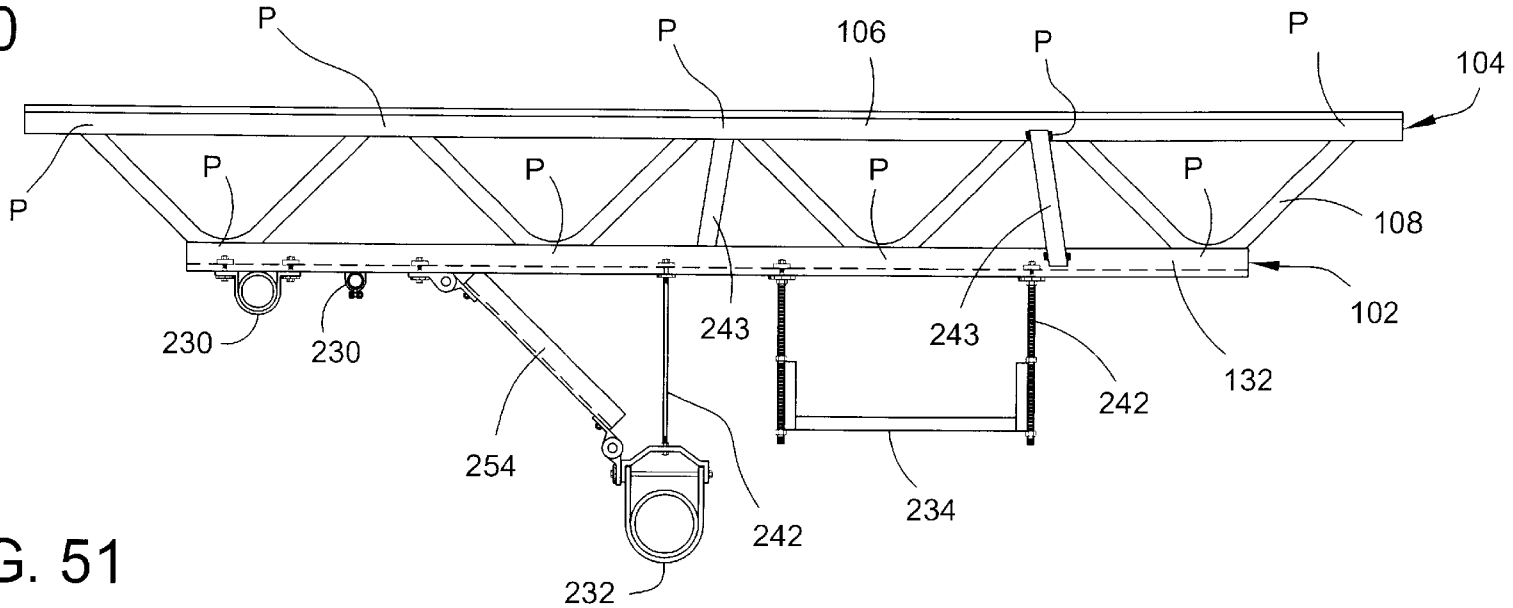
Figure 51:
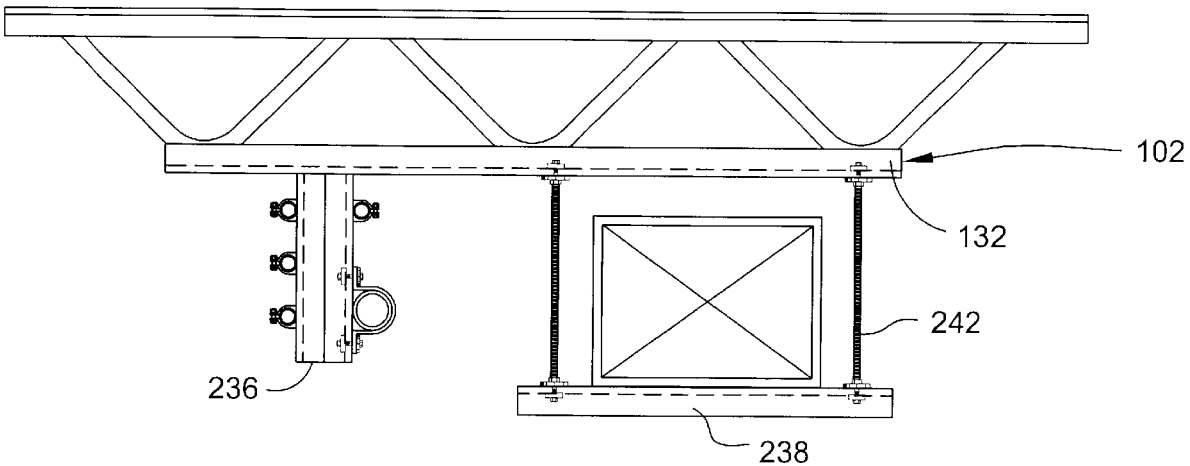

As previously noted, the prior art shows several devices designed to fasten to, connect with, or otherwise directly engage a strut member. For illustration, see U.S. Pat. No. 4,037,098 (swivel connector), U.S. Pat. No. 4,146,074, (fastener), U.S. Pat. No. 4,238,157 (connector), U.S. Pat. No. 4,305,557 (pipe hanger), U.S. Pat. No. 4,460,299 (fastener), U.S. Pat. No. 5,022,614 (one-piece conduit clip), U.S. Pat. No. 5,100,086 (cable tray support system), U.S. Pat. No. 5,163,644 (conduit clamp), U.S. Pat. No. 5,209,619 (channel nut fastener), and U.S. Pat. No. 5,848,770 (clevis hanger). FIGS. 50 and 51 show attachment of various items directly in the slot 142 of the strut 132 of the bottom chord 102 of an elongate member. FIG. 50 shows pipe mounting brackets 230, a pipe hanging bracket 232 suspended from a threaded rod 242 and an electrical cable tray 234 suspended from threaded rods, all mounted on the bottom chord 102. Panel points P are defined at those points along the elongate member where the webs 108 intersect the top and bottom chords 102, 104. When an item, such as a threaded rod 242, is mounted on the bottom chord 102 between panel points P, a web support 243, spanning the distance between the chords 102, 104, is added to distribute weight between both chords to inhibit bending of the chords. The supports 243 can mount on the outside lateral portions of chords 102, 104, as shown, or may mount between the angle bars 106 and strut members 132, similar to the web 108. Customarily, the supports 243 are welded to the chords 102, 104, but the present invention facilitates attachment of the supports to strut 132 by means of fasteners, similar to the attachment of items to the strut. Although not shown in each figure, the supports 243 depicted in FIG. 50 are readily adaptable to each of the embodiments of the present invention.

Figure 52:
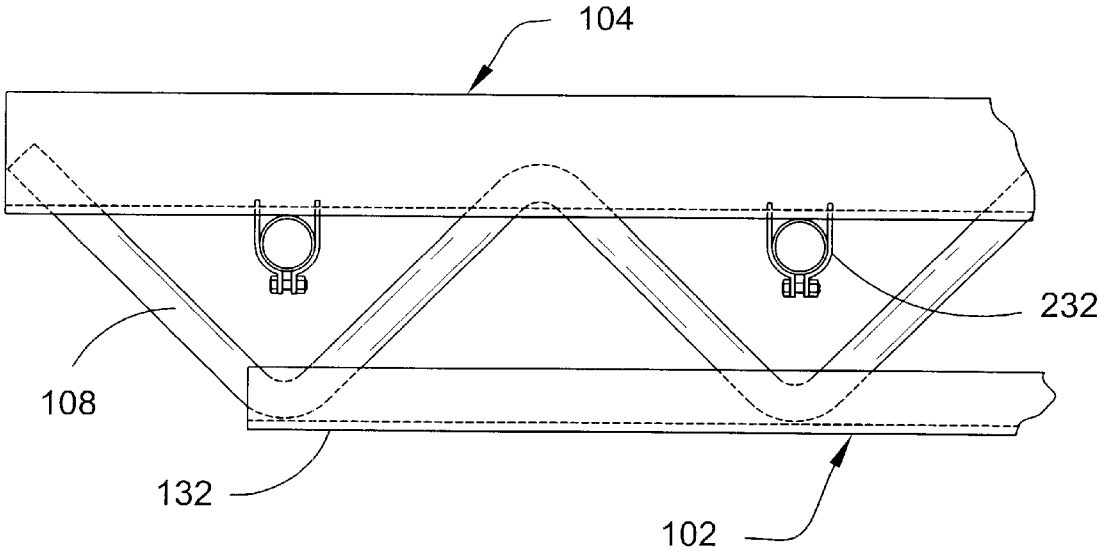
Figure 53:
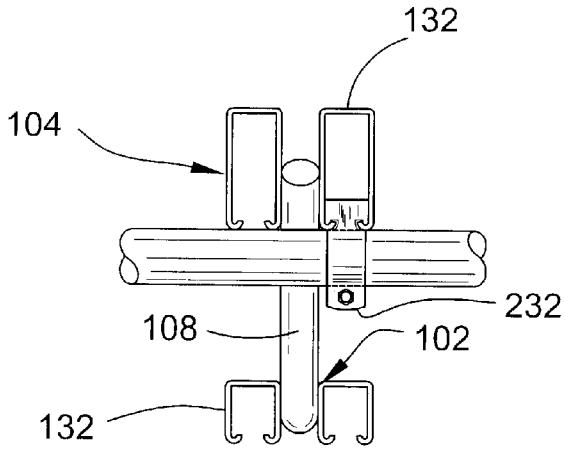

FIG. 51 shows a pipe mounting column 236 and a hanging platform 238 suspended from threaded rods 242, both mounted on the bottom chord 102. FIGS. 52 and 53 show a pipe hanger 232 mounted on the top chord 104 for holding a pipe. This arrangement allows for mounting of objects directly to the structural member, such that the objects pass through the web of the structural member. Different chord 102/104 arrangements and strut 132 cross sections as shown in the previous embodiments are each readily usable for attachment of similar items for supporting objects. Every possible combination is not described here, although each comprises part of the present invention.

FIG. 54 shows an embodiment where the channel 134 defined by the strut 132 is used as a raceway 244. Electrical junction boxes 246 mount directly to the strut 132 and the strut serves as an electrical raceway 244 for electrical wiring 240 and the like. In addition, the raceway 244 may guide and store other forms of continuous wiring or cable. To retain the items within the raceway 244, a push-on cover 248 is inserted lengthwise of the strut 132. The preferred cover 248 has two continuous tabs 250 engageable with the lips 150 of the strut 132 to retain the cover in place on the strut (FIG. 56). The tabs 250 are preferably resilient so that the cover 248 may be temporarily removed from the strut 132 for access to the wires and subsequently reinserted into the strut for replacement of the cover on the strut. FIG. 55 shows attachment of electrical lighting fixtures 252 to the strut 132 members of the bottom chord 102. In each configuration, electrical energy is supplied from electrical wires 240 running through the strut 132 of the structural member, eliminating the need for an additional electrical raceway for bringing electrical power to the fixtures.

Figure 57:
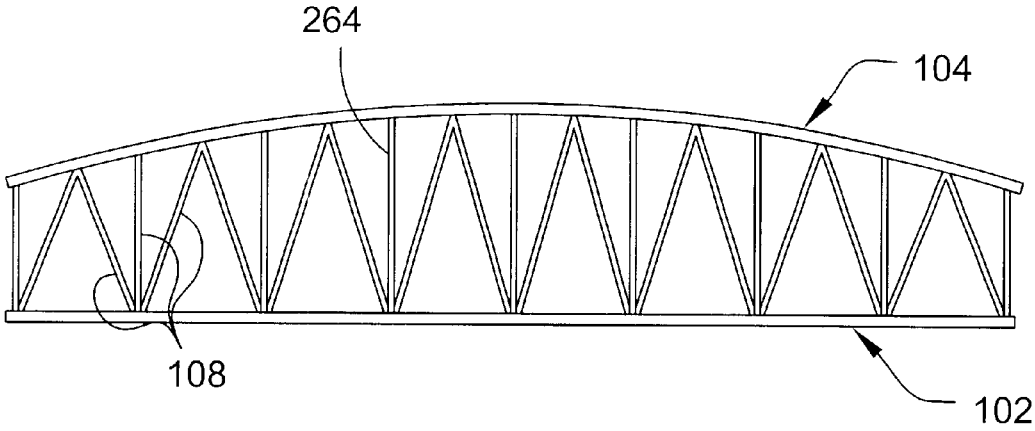
FIGS. 57–59 show elongate structural members having chords not parallel to one another.
Figure 58:
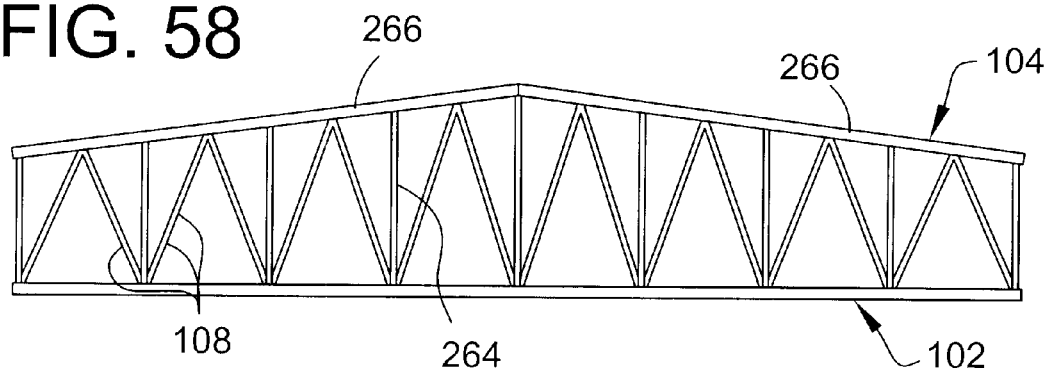
Figure 59:
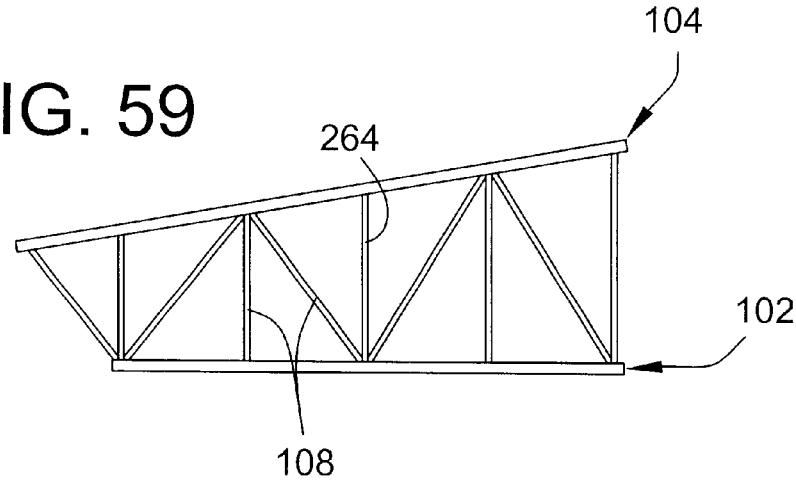

FIG. 57 shows another embodiment of the present invention in which the bottom chord 102 and top chord 104 are not parallel, the top chord 104 being spaced apart from the bottom chord 102 a greater distance at the center than at the ends of the member. In this particular embodiment, the top chord 104 is upwardly bowed. The web 108 of the structural member includes vertical posts 264 extending between the top 104 and bottom chords 102 between diagonal reaches of the zigzag stock. This embodiment may be used in applications where the top chord 104 must support a structure not parallel to the bottom chord 102. Any of the previous embodiments of strut 132 design, web 108 design, and attachment methods are applicable to this embodiment. Further, FIG. 58 shows a structural member wherein the top chord 104 has straight halves 266 slanting to a peak. As in the previous embodiment, the web 108 includes vertical posts 264 between the top and bottom chords 104/102. This embodiment is useful where a layer of roofing material is attached to the top chord 104 of adjacent elongate structural members such that the members, acting in concert, form a peaked roof. Finally, FIG. 59 discloses an elongate structural member wherein the bottom chord 102 and top chord 104 are straight, but not parallel. This design additionally incorporates vertical posts 264 between diagonal reaches of the zigzag stock.

Figure 60:
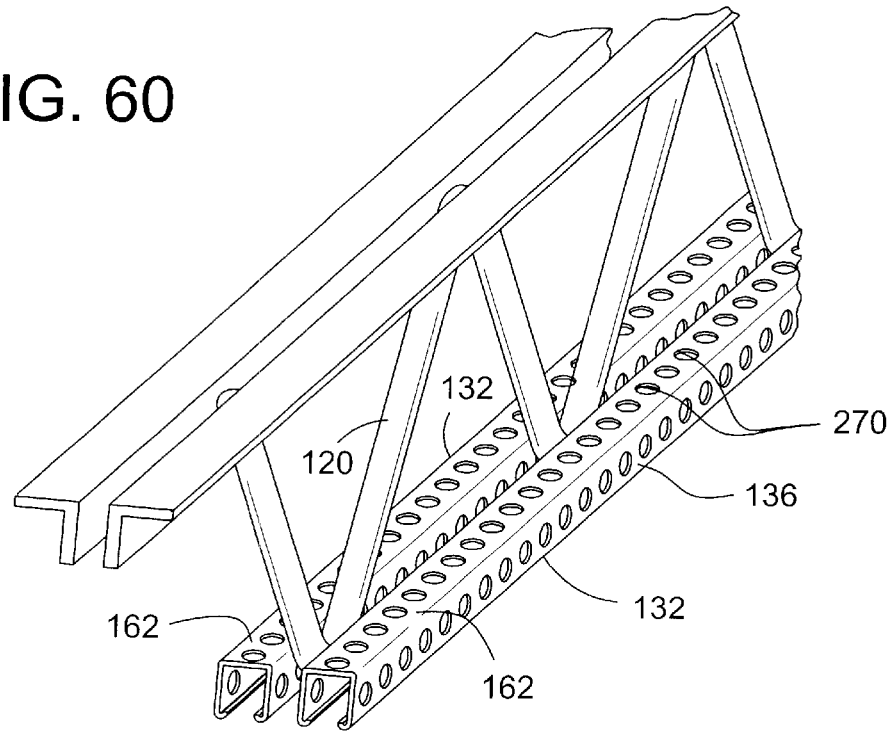
FIGS. 60–62 show elongate structural members comprising chords fabricated from strut members having holes and/or slots formed therein.
Figure 61:
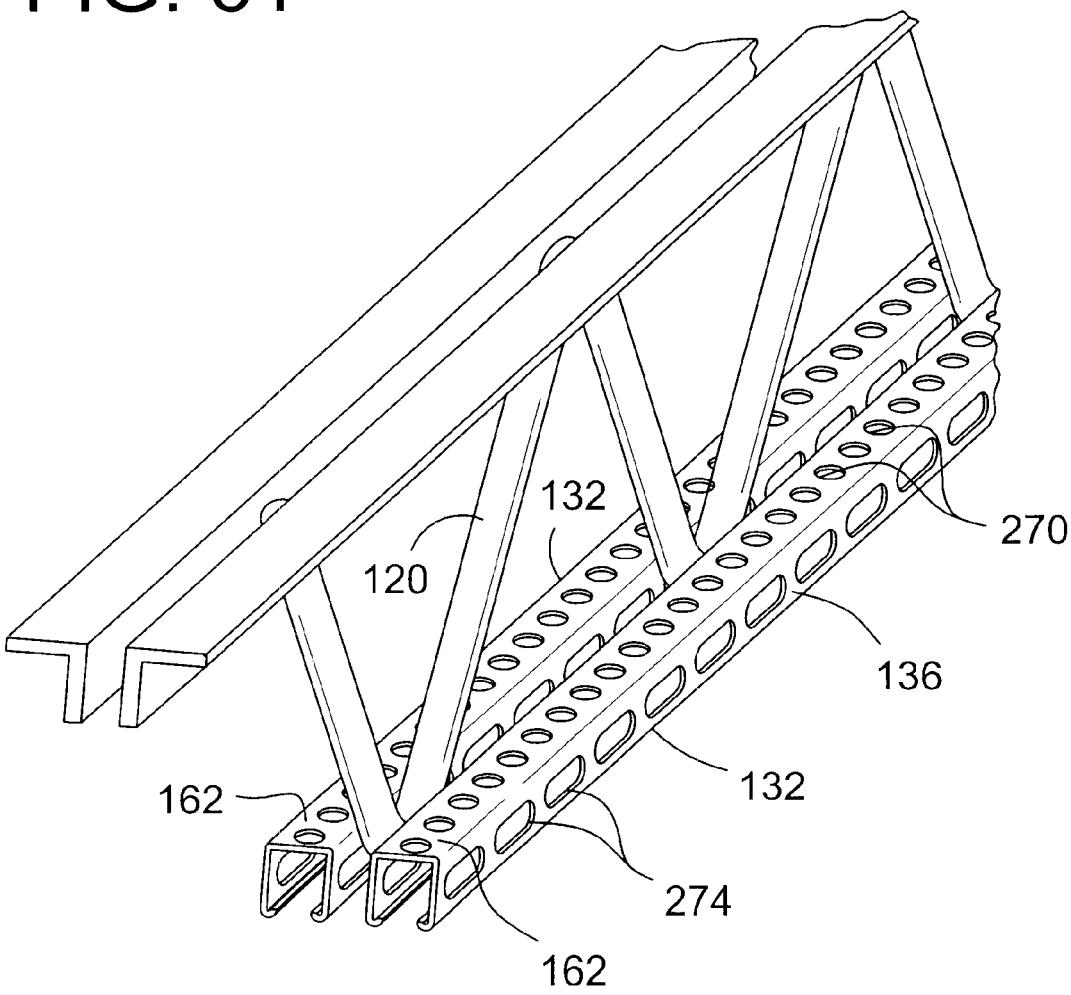

FIG. 60 shows an embodiment of the present invention in which the strut members 132 have a plurality of holes 270 formed in their back walls 162. These holes 270 act as further attachment points for items for supporting objects. Holes 270 are additionally formed in the side walls 136 of the strut 132 for attachment of items to the strut. Further, oblong slots 274 may be formed in the back walls 162 (not shown) or side walls 136 (FIG. 61) of the strut members 132. Although the strut members 132 of this embodiment are shown in combination with a web formed from round bar stock 120 bent into zigzag configuration, the strut members 132 could be used in combination with the webs of any of the previous embodiments.

Figure 62:
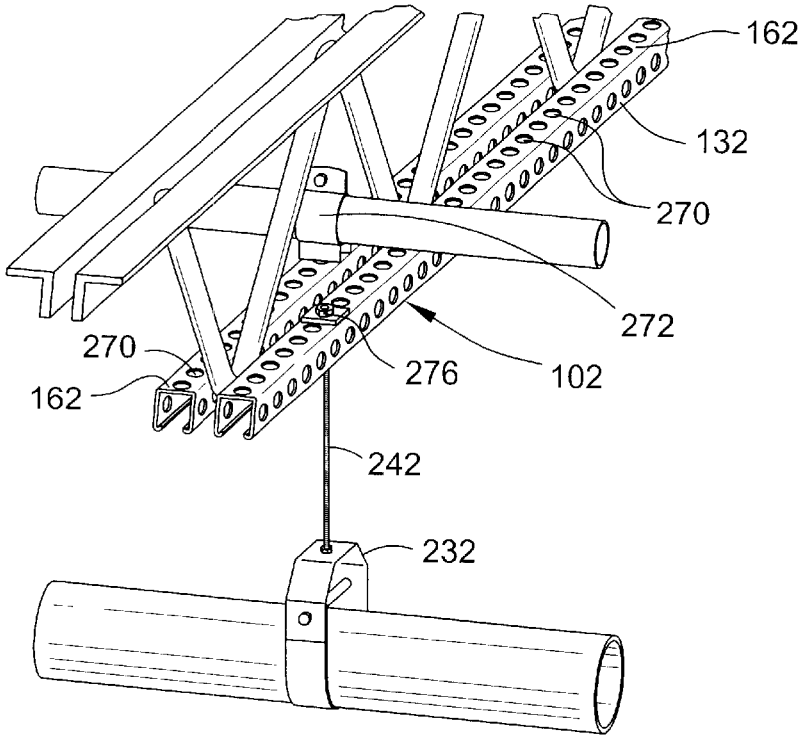

FIG. 62 shows attachment of items directly to the strut 132 of the bottom chord 102 of an elongate member via holes 270 in the strut. An upwardly extending pipe mounting bracket 272 mounts on the top of a strut member 132, and a pipe hanging bracket 232 is suspended from a threaded rod 242 extending through the back wall 162 of the strut member. Both the upwardly extending pipe mounting bracket 272 and the threaded rod 242 attach directly to the strut 132 through holes 270 formed in the back wall 162 of the strut members 132. The pipe mounting bracket 272 attaches to the strut 132 via a bolt (not shown) threaded through a hole 270 in the strut and a hole (not shown) in the bracket. The threaded rod 242 extends upward through a hole 270 in the strut 132 and is secured in place by a nut 276 engaging the strut 132. Other attachment items may attach via other holes 270 or slots 274 formed in different portions of the strut members 132 without departing from the scope of this invention.

In view of the above, it will be seen that the several objects of the invention are achieved and other advantageous results attained.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above without departing from the scope of the invention, it is intended that all matter contained in the above description and shown in the accompanying drawings shall be interpreted as illustrative and not in a limiting sense.

What is claimed is:

1. An elongate structural member comprising a first chord and a second chord extending lengthwise of said structural member with a space therebetween and a web spanning said space, said web at least comprising at least one length of metal bar stock of solid cross section having bends forming said length of zigzag configuration, a first set of bends being disposed along a first margin of the web and a second set of bends being disposed along a second margin of the web, the first chord comprising at least two struts, one on each side of the web at a respective margin of the web, each strut comprising a metal channel having generally opposing walls constituting flanges of said channel, said flanges having inwardly directed lips at their outer ends, said lips being spaced from one another to define a slot therebetween extending the length of the strut, each strut being secured in engagement with the respective side of the web and being adapted for insertion through its said slot of items to be retained in the strut.

2. A structural member as set forth in claim 1 wherein the width of said bar stock at said bends is substantially equal to the width of said bar stock in its reaches between the chords.

3. A structural member as set forth in claim 1 wherein said first chord further comprises two additional struts, one on each side of the web, each said additional strut also comprising a metal channel with lips corresponding to the first-mentioned struts, each said additional strut having one of its walls in flatwise engagement with one of the walls of a respective one of the first-mentioned struts and its slot open.

4. A structural member such as a joist or the like as set forth in claim 1 wherein the chords are top and bottom chords and said first chord is the bottom chord.

5. A structural member as set forth in claim 4 wherein said top and bottom chords are generally parallel and said web is solely of zigzag configuration.

6. A structural member as set forth in claim 4 wherein the chords are top and bottom chords, said top chord being spaced from the bottom chord a greater distance at the center than at the ends of said member.

7. A structural member as set forth in claim 6 wherein the web includes vertical posts extending between the chords between diagonal reaches of the zigzag stock.

8. A structural member as set forth in claim 6 wherein the top chord has straight halves slanting to a peak.

9. A structural member as set forth in claim 6 wherein the top chord is of upwardly bowed configuration.

10. A structural member as set forth in claim 4 wherein said bottom chord comprises two of said struts on each side.

11. A structural member as set forth in claim 4 wherein each of said two bottom chord struts has a wall in engagement with the respective side of said web and welded thereto.

12. A structural member as set forth in claim 11 wherein each of said two bottom chord struts has one of its flanges in engagement with the respective side of said web and welded thereto.

13. A structural member as set forth in claim 12 wherein each of the two bottom chord struts is welded to the web with its slot down.

14. A structural member as set forth in claim 12 wherein each of the two bottom chord struts is welded to the web with its slot up.

15. A structural member as set forth in claim 14 wherein each of the two said bottom chord struts has an additional strut comprising a metal channel with lips corresponding to the first-mentioned struts with a back wall of each said additional strut in engagement with a back wall of the respective said bottom chord strut and welded thereto slot down.

16. A structural member as set forth in claim 12 wherein one of the said bottom chord struts is welded to the web with its slot down and the other said bottom chord strut is welded to the web with its slot up.

17. A structural member as set forth in claim 11 wherein each bottom chord strut has a back wall in engagement with the respective side of said zigzag web and welded thereto, each bottom chord strut thereby having its slot generally in a vertical plane spaced laterally outwardly from the zigzag web.

18. A structural member as set forth in claim 11 wherein the said first two bottom chord struts extend down below the bottom of the zigzag web and there is a third bottom chord strut comprising a metal channel with lips corresponding to said first two struts, said third bottom chord strut being welded in place with a back wall of the strut in engagement with the bottom of the zigzag web and with said third bottom chord strut between said first two bottom chord struts.

19. A structural member as set forth in claim 1 wherein the second chord comprises a pair of angle bars on opposite sides of the web at the respective margins of the web, each of said angle bars having one leg thereof in flatwise engagement with the respective side of the zigzag web and welded thereto and the other leg thereof extending laterally outward.

20. A structural member as set forth in claim 19 wherein said chords are top and bottom chords, said first chord is the bottom chord and said second chord is the top chord.

21. A structural member as set forth in claim 1 wherein said chords are top and bottom chords, said first chord is the bottom chord, and said top chord comprises a pair of struts on opposite sides of the web at the top margin of the web, each said top chord strut comprising a sheet metal channel having a shape in transverse cross section corresponding to the shape in transverse cross section of the bottom chord struts, each top chord strut having the outside of one of its walls in flatwise engagement with the respective side of said zigzag web and welded thereto.

22. A structural member as set forth in claim 21 wherein each top chord strut has the outside of one of its flanges in flatwise engagement with the respective side of said zigzag web and welded thereto.

23. A structural member as set forth in claim 22 wherein each top chord strut is so welded to the web as to extend up above the top of the web.

24. A structural member as set forth in claim 23 wherein each top chord strut is welded to said web with its slot down.

25. A structural member as set forth in claim 24 wherein each top chord strut is so welded to the web as to extend up above the top of the web.

26. A structured member as set forth in claim 23 wherein each top chord strut is welded to said web with its slot up.

27. A structural member as set forth in claim 26 wherein each top chord strut is so welded to the web as to extend up above the top of the web.

28. A structural member as set forth in claim 21 wherein each top chord strut has a back wall in flatwise engagement with the respective side of said zigzag web and welded thereto, each top chord strut thereby having its lips between diagonal reaches of the zigzag stock.

29. A structural member as set forth in claim 1 further comprising a cover engageable with the strut for closing the slot whereby the strut may be used as a raceway for electrical wires and the like.

30. An elongate structural member comprising a first chord and a second chord extending lengthwise of said structural member with a space therebetween and a web structure spanning said space, at least one of said chords comprising an elongate strut comprising an elongate metal channel having generally opposing walls constituting flanges of the channel, said flanges having inwardly directed lips at their outer ends, said lips being spaced from one another to define a slot therebetween extending the length of the strut, said web structure comprising at least a plurality of metal bars extending diagonally with respect to the chords, one set of said bars being on one side of said chords having end portions in engagement with the outside of the chords and another set of said bars being on the other side of said chords having end portions in engagement with the outside of the chords, said end portions of said bars being secured to the strut.

31. An elongate structural member comprising a first chord and a second chord extending lengthwise of said structural member with a space therebetween and a web spanning said space, the first chord comprising at least two struts, one on each side of the web at a respective margin of the web, each said strut comprising a metal channel having generally opposing walls constituting flanges of said channel, said flanges having inwardly directed lips at their outer ends, said lips being spaced from one another to define a slot therebetween extending the length of the strut, each strut being secured in engagement with the respective side of the web and being adapted for insertion through its said slot of items to be retained in the strut, each of said lips having a hook-like configuration for gripping engagement by said items.

32. An elongate structural member comprising a first chord and a second chord extending lengthwise of said structural member with a space therebetween and a web spanning said space, the first chord comprising at least two struts, one on each side of the web at a respective margin of the web, each said strut comprising a metal channel having generally opposing walls constituting flanges of said channel, said flanges having inwardly directed lips at their outer ends, said lips being spaced from one another to define a slot therebetween extending the length of the strut, each strut being secured in engagement with the respective side of the web and being adapted for insertion through its said slot of items to be retained in the strut, wherein said metal channel is formed to have flanges and lips of substantially identical uniform thickness.

33. An elongate structural member as set forth in ciaim 32 wherein said lips extend inwardly from respective flanges toward one another a distance of at least ⅛ inch.

34. An elongate structural member comprising a first chord and a second chord extending lengthwise of said structural member with a space therebetween and a web spanning said space, the first chord comprising one or more struts at a respective margin of the web, each of said one or more struts comprising a metal channel having generally opposing walls constituting flanges of said channel, said flanges having inwardly directed lips at their outer ends to define a slot therebetween extending from one lip to the other and the length of the strut, each of said one or more struts being secured in engagement with the web and being adapted for insertion through its said slot of items to be retained in the strut, said web being constructed of angle bars.

35. An elongate structural member as set forth in claim 34 wherein each channel further comprises a substantially planar back wall connecting the two flanges.

36. An elongate structural member as set forth in claim 34 wherein said slot is unobstructed along its length.

37. An elongate structural member comprising a first chord and a second chord extending lengthwise of said structural member with a space therebetween and a web spanning said space, said web at least comprising at least one length of metal bar stock having bends forming said length of zigzag configuration, a first set of bends being disposed along a first margin of the web and a second set of bends being disposed along a second margin of the web, the first chord comprising at least two struts, one on each side of the web at a respective margin of the web, each strut comprising a metal channel having a back wall and generally opposing side walls constituting flanges of said channel, said flanges having inwardly directed lips at their outer ends, said lips being spaced from one another to define a slot therebetween extending the length of the strut, each strut being secured in engagement with a respective side of the web and having at least one hole in at least one wall of the metal channel for use in retaining items on the strut.

38. An elongate structural member as set forth in claim 37 wherein said hole is oblong with semicircular end portions connected by straight, parallel sides.

39. An elongate structural member comprising a first chord and a second chord extending lengthwise of said structural member with a space therebetween and a web spanning said space, the first chord comprising one or more struts at a respective margin of the web, each of said one or more struts comprising a metal channel having generally opposing walls constituting flanges of said channel, said flanges having inwardly directed lips at their outer ends to define a slot therebetween extending the length of the strut, each of said one or more struts being secured in engagement with the web and being adapted for insertion through its said slot of items to be retained in the strut, each of said lips having a hook-like configuration for gripping engagement by said items, said web being constructed of structural members other than metal channel.

* * * * *